US007699652B2

(12) United States Patent
Yotsutani

(10) Patent No.: US 7,699,652 B2
(45) Date of Patent: Apr. 20, 2010

(54) ELECTRICAL COAXIAL CONNECTOR

(75) Inventor: Kenichi Yotsutani, Tokyo (JP)

(73) Assignee: I-Pex Co., Ltd. (JP)

( * ) Notice: Subject to any disclaimer, the term of this patent is extended or adjusted under 35 U.S.C. 154(b) by 0 days.

(21) Appl. No.: 12/537,082

(22) Filed: Aug. 6, 2009

(65) Prior Publication Data

US 2009/0298333 A1 Dec. 3, 2009

Related U.S. Application Data

(62) Division of application No. 12/059,648, filed on Mar. 31, 2008.

(30) Foreign Application Priority Data

Dec. 5, 2007 (JP) ..... 2007-314483

(51) Int. Cl.
*H01R 13/00* (2006.01)

(52) U.S. Cl. ..... 439/581; 439/63

(58) Field of Classification Search ..... 439/63, 439/578, 675, 581, 582–585
See application file for complete search history.

(56) References Cited

U.S. PATENT DOCUMENTS 6,533,610 B1 3/2003 Dai et al.
6,607,400 B1 8/2003 Ko
6,974,340 B2 12/2005 Zech et al.
7,025,598 B2 * 4/2006 Ikeda ..... 439/63
7,367,811 B2 5/2008 Nagata
2001/0027033 A1 10/2001 Fujimoto et al.
2003/0129858 A1 * 7/2003 Huang et al. ..... 439/63
2004/0102061 A1 5/2004 Watanabe
2006/0024985 A1 2/2006 Nagata et al.
2006/0141811 A1 6/2006 Shichida et al.
2009/0149063 A1 6/2009 Yotsutani

FOREIGN PATENT DOCUMENTS

JP 2004-063372 2/2004

* cited by examiner

*Primary Examiner*—Hien Vu
(74) *Attorney, Agent, or Firm*—Studebaker & Brackett PC; Donald R. Studebaker

(57) ABSTRACT

An electrical coaxial connector comprising a body made of insulator to be put on a circuit board, a signal-joining contacting conductor held by the body, and a grounding contacting conductor formed into a cylindrical shape and held also by the body for surrounding the signal-joining contacting conductor on the circuit board, wherein the grounding contacting conductor has an arm portion extending toward the circuit board from one of ring-shaped ends of the grounding contacting conductor, which is more distant from the circuit board than the other, a grounding terminal portion is formed at an end of the arm portion to be soldered to a ground-potential terminal provided on the circuit board, and each of the grounding contacting conductor and the arm portion is resilient.

2 Claims, 7 Drawing Sheets

ELECTRICAL COAXIAL CONNECTOR

This application is a divisional of U.S. application Ser. No. 12/059,648, filed Mar. 31, 2008, pending.

BACKGROUND OF THE INVENTION

1. Field of the Invention

The present invention relates generally to an electrical coaxial connector, and more particularly to an improvement in an electrical coaxial connector to be mounted on a circuit board for transmitting signals from the circuit board to the outside thereof under a condition of electro-magnetic shield.

2. Description of the Prior Art

A high-frequency signal flowing through conductors arranged on a circuit board is mostly dealt with as a signal which requires being put in a condition of electro-magnetic shield so as to be inactive to leak out from the conductors or to prevent noises from mixing thereinto from the outside. For transmitting the high-frequency signal on the circuit board to the outside thereof, for example, to another circuit board, under the condition of electro-magnetic shield, an electrical coaxial connector to be mounted on a circuit board is used.

Such an electrical coaxial connector comprises usually a signal-joining contacting conductor provided for transferring a signal and a grounding contacting conductor provided for surrounding the signal-joining contacting conductor to be supplied with a ground potential so as to put the signal supplied to the signal-joining contacting conductor in a condition of electro-magnetic shield. When the electrical coaxial connector is mounted on a circuit board to be used, the electrical coaxial connector is coupled with another electrical coaxial connector which is, for example, mounted on another circuit board, so that the signal-joining contacting conductor comes into contact with another signal-joining contacting conductor provided in the other electrical coaxial connector and the grounding contacting conductor comes into contact with another grounding contacting conductor provided in the other electrical coaxial connector. With the electrical coaxial connectors coupled with each other in such a manner, the signal supplied to one of the signal-joining contacting conductors is transferred to the other of the signal-joining contacting conductors under the condition of electro-magnetic shield brought about by the grounding contacting conductors. Thereby, the signal is transmitted between the circuit boards, on each of which the electrical coaxial connector is mounted, under the condition of electro-magnetic shield.

When the electrical coaxial connector as mentioned above is mounted on the circuit board, the signal-joining contacting conductor is connected to a signal terminal provided on the circuit board and the ground-connecting contacting conductor is connected to a ground-potential terminal provided on the circuit board. It is usual that a grounding terminal portion of the grounding contacting conductor is soldered to the ground-potential terminal provided on the circuit board so that the grounding contacting conductor is connected to the ground-potential terminal and a soldered condition of the grounding terminal portion of the grounding contacting conductor with the ground-potential terminal provided on the circuit board is required to be properly maintained for a relatively long period of time.

There has been proposed to provide an improved electrical coaxial connector in which a grounding contacting conductor has a distinctive grounding terminal portion which is provided to be soldered to a ground-potential terminal provided on a circuit board and so contrived in its shape that a soldered condition of the grounding terminal portion of the grounding contacting conductor with the ground-potential terminal provided on the circuit board is improved, as disclosed in, for example, the Japanese patent application published before examination under publication number 2004-63372.

The previously proposed electrical coaxial connector disclosed in the publication mentioned above comprises, for example, a signal-joining contacting conductor (contact) formed with a U-shaped conductive strip, a body made of insulator such as plastics or the like and provided to be put on a circuit board for holding the signal-joining contacting conductor at its central portion, and a grounding contacting conductor (shell) formed into a cylindrical shape for surrounding each of the body and the signal-joining contacting conductor held by the body to contain the same therein. When the body made of insulator is put on the circuit board, a contacting projection (signal terminal) provided on the signal-joining contacting conductor comes into contact with a signal terminal (pad) provided on the circuit board, so that the signal-joining contacting conductor formed into a U-shape is connected to the signal terminal provided on the circuit board. A plurality of grounding terminal portions (second ground-potential terminal) each formed into a plate shape are provided on a ring-shaped end of the grounding contacting conductor for coming into contact with ground-potential terminals (ground-potential pads) provided on the circuit board and soldered respectively to the ground-potential terminals provided on the circuit board, so that the grounding contacting conductor is connected to the ground-potential terminals on the circuit board.

Under such a situation, each of the grounding terminal portions provided on the ring-shaped end of the grounding contacting conductor is shaped to have chamfered edges or round-cornered so as to prevent the grounding terminal portions from being removed from the ground-potential terminals provided on the circuit board or to prevent the ground-potential terminals provided on the circuit board from being separated from the circuit board and thereby it is intended that the ground-potential is stabilized and each of the ground-potential terminals provided on the circuit board is strengthened in resistivity against separation from the circuit board.

In the above-mentioned previously proposed electrical coaxial connector in which the grounding terminal portions each formed into the plate shape and provided on the ring-shaped end of the grounding contacting conductor formed into the cylindrical shape are soldered respectively to the ground-potential terminals on the circuit board and thereby the grounding contacting conductor is connected to the ground-potential terminals on the circuit board, a soldered portion on the circuit board, at which the grounding terminal portion provided on the ring-shaped end of the grounding contacting conductor is soldered to the ground-potential terminals provided on the circuit board, receives undesirable stress exerted thereto so as to be feared to bring about troubles when the previously proposed electrical coaxial connector is coupled with another electrical coaxial connector with the signal-joining contacting conductor thereof coming into contact with another signal-joining contacting conductor provided in the other electrical coaxial connector and the grounding contacting conductor thereof coming into contact with another grounding contacting conductor provided in the other electrical coaxial connector.

That is, in the previously proposed electrical coaxial connector put in a condition wherein the signal-joining contacting conductor comes into contact with the other signal-joining contacting conductor provided in the other electrical coaxial connector and the grounding contacting conductor comes into contact with the other grounding contacting conductor provided in the other electrical coaxial connector, the grounding contacting conductor is resiliently transformed by engagement with the other grounding contacting conductor provided in the other electrical coaxial connector and operative to exert resilient force arising from its transformation to the other grounding contacting conductor provided in the other electrical coaxial connector and to lock the same when the grounding contacting conductor comes into contact with and then is in contact with the other grounding contacting conductor provided in the other electrical coaxial connector. Thereby, the stress arising from the transformation of the grounding contacting conductor is inflicted upon the soldered portion on the circuit board at which the grounding terminal portion provided on the ring-shaped end of the grounding contacting conductor is soldered to the ground-potential terminal provided on the circuit board.

As a result, with repetitions of the condition wherein the soldered portion on the circuit board at which the grounding terminal portion provided on the ring-shaped end of the grounding contacting conductor is soldered to the ground-potential terminals provided on the circuit board receives the undesirable stress exerted thereto, it is feared that cracks in solder, remove of the grounding terminal portion of the grounding contacting conductor form the ground-potential terminal on the circuit board, separation of the ground-potential terminal from the circuit board and so on are brought about on the soldered portion on the circuit board and thereby the soldered condition of the grounding terminal portion provided on the ring-shaped end of the grounding contacting conductor with the ground-potential terminal provided on the circuit board can not be properly maintained.

OBJECTS AND SUMMARY OF THE INVENTION

Accordingly, it is an object of the present invention to provide an electrical coaxial connector comprising a body made of insulator to be put on a circuit board, a signal-joining contacting conductor held by the body and provided with a signal-joining terminal portion to be connected to a signal terminal provided on the circuit board, and a grounding contacting conductor held also by the body for surrounding the signal-joining contacting conductor and provided with a grounding terminal portion to be connected to a ground-potential terminal provided on the circuit board, wherein the grounding terminal portion provided on the grounding contacting conductor is soldered to the ground-potential terminal provided on the circuit board so that the grounding contacting conductor is connected to the ground-potential terminal provided on the circuit board when the electrical coaxial connector in its entirety is mounted on the circuit board, and which avoids the aforementioned problems and disadvantages encountered with the prior art.

Another object of the present invention is to provide an electrical coaxial connector comprising a body made of insulator to be put on a circuit board, a signal-joining contacting conductor held by the body and provided with a signal-joining terminal portion to be connected to a signal terminal provided on the circuit board, and a grounding contacting conductor held also by the body for surrounding the signal-joining contacting conductor and provided with a grounding terminal portion to be connected to a ground-potential terminal provided on the circuit board, wherein the grounding terminal portion provided on the grounding contacting conductor is soldered to the ground-potential terminal provided on the circuit board so that the grounding contacting conductor is connected to the ground-potential terminal provided on the circuit board when the electrical coaxial connector in its entirety is mounted on the circuit board, and with which a soldered condition of the grounding terminal portion of the grounding contacting conductor with the ground-potential terminal provided on the circuit board can be properly maintained for a relatively long period of time.

A further object of the present invention is to provide an electrical coaxial connector comprising a body made of insulator to be put on a circuit board, a signal-joining contacting conductor held by the body and provided with a signal-joining terminal portion provided on the signal-joining contacting conductor is connected to a signal terminal provided on the circuit board, and a grounding contacting conductor held also by the body for surrounding the signal-joining contacting conductor and provided with a grounding terminal portion to be connected to a ground-potential terminal provided on the circuit board, wherein the grounding terminal portion provided on the grounding contacting conductor is soldered to the ground-potential terminal provided on the circuit board so that the grounding contacting conductor is connected to the ground-potential terminal provided on the circuit board when the electrical coaxial connector in its entirety is mounted on the circuit board, and with which stress exerted to a soldered portion on the circuit board at which the grounding terminal portion of the grounding contacting conductor is soldered to the ground-potential terminal provided on the circuit board is effectively reduced when the electrical coaxial connector is coupled with another electrical coaxial connector with the signal-joining contacting conductor thereof coming into contact with another signal-joining contacting conductor provided in the other electrical coaxial connector and the grounding contacting conductor thereof coming into contact with another grounding contacting conductor provided in the other electrical coaxial connector.

A still further object of the present invention is to provide an electrical coaxial connector comprising a body made of insulator to be put on a circuit board, a signal-joining contacting conductor held by the body and provided with a signal-joining terminal portion to be connected to a signal terminal provided on the circuit board, and a grounding contacting conductor held also by the body for surrounding the signal-joining contacting conductor and provided with a grounding terminal portion to be connected to a ground-potential terminal provided on the circuit board, wherein the grounding terminal portion provided on the grounding contacting conductor is soldered to the ground-potential terminal provided on the circuit board so that the grounding contacting conductor is connected to the ground-potential terminal provided on the circuit board when the electrical coaxial connector in its entirety is mounted on the circuit board, and which minimizes a fear that cracks in solder, remove of the grounding terminal portion of the grounding contacting conductor form the ground-potential terminal on the circuit board, separation of the ground-potential terminal from the circuit board and so on are brought about on a soldered portion on the circuit board at which the grounding terminal portion of the grounding contacting conductor is soldered to the ground-potential terminal provided on the circuit board by stress exerted to the soldered portion.

According to a first aspect of the present invention, as claimed in accompanying claims, there is provided an electrical coaxial connector, which comprises a body made of insulator to be put on a circuit board, a signal-joining contacting conductor held by the body and provided with a signal-joining terminal portion to be connected to a signal terminal provided on the circuit board, and a grounding contacting conductor formed into a cylindrical shape and held also by the body for surrounding the signal-joining contacting conductor on the circuit board, wherein the grounding contacting conductor has an arm portion extending toward the circuit board from one of ring-shaped ends of the grounding contacting conductor, which is more distant from the circuit board than the other, a grounding terminal portion is formed at an end of the arm portion to be soldered to a ground-potential terminal provided on the circuit board, and each of the grounding contacting conductor and the arm portion is resilient.

In one embodiment of the electrical coaxial connector according to the first aspect of the present invention, a plurality of arm portions, at an end of each of which the grounding terminal portion is formed, are provided on the ring-shaped end of the grounding contacting conductor.

Further, according to a second aspect of the present invention, as claimed in accompanying claims, there is provided an electrical coaxial connector, which comprises a body made of insulator to be put on a circuit board, a signal-joining contacting conductor held by the body and provided with a signal-joining terminal portion to be connected to a signal terminal provided on the circuit board, and a grounding contacting conductor formed into a cylindrical shape and held also by the body for surrounding the signal-joining contacting conductor on the circuit board, wherein the grounding contacting conductor has an arm portion extending from a cylindrical side wall portion of the grounding contacting conductor in parallel with the circuit board, a grounding terminal portion is formed at an end of the arm portion to be soldered to a ground-potential terminal provided on the circuit board, and each of the grounding contacting conductor and the arm portion is resilient.

In one embodiment of the electrical coaxial connector according to the second aspect of the present invention, a couple of arm portions, at an end of each of which the grounding terminal portion is formed, are provided on the cylindrical side wall portion of the grounding contacting conductor with a predetermined space between.

When the electrical coaxial connector constituted as described above in accordance with the first or second aspect of the present invention is put in actual use, the body is put on the circuit board with the signal-joining terminal portion of the contacting conductor connected to the signal terminal on the circuit board and the grounding terminal portion of the grounding contacting conductor soldered to the ground-potential terminal on the circuit board so that the electrical coaxial connector in its entirety is mounted on the circuit board. Then, the electrical coaxial connector according to the present invention thus mounted on the circuit board is coupled with another electrical coaxial connector.

When the electrical coaxial connector according to the present invention is coupled with the other electrical coaxial connector, the signal-joining contacting conductor comes into contact with another signal-joining contacting conductor provided in the other electrical coaxial connector and the grounding contacting conductor formed into the cylindrical shape comes into contact with another grounding contacting conductor provided in the other electrical coaxial connector. The grounding contacting conductor formed into the cylindrical shape is resiliently transformed by engagement with the other grounding contacting conductor provided in the other electrical coaxial connector and operative to exert resilient force arising from its transformation to the other grounding contacting conductor provided in the other electrical coaxial connector and to lock the same when the grounding contacting conductor formed into the cylindrical shape comes into contact with and then is in contact with the other grounding contacting conductor provided in the other electrical coaxial connector.

In such a situation, stress arising from the resilient transformation of the grounding contacting conductor formed into the cylindrical shape is wasted to transform resiliently the resilient arm portion which extends toward the circuit board from one of the ring-shaped ends of the grounding contacting conductor, which is more distant from the circuit board than the other, or extends from the cylindrical side wall portion of the grounding contacting conductor in parallel with the circuit board and absorbed into the resilient arm portion to be attenuated. As a result, the stress arising from the resilient transformation of the grounding contacting conductor is effectively reduced to be less transmitted through the resilient arm portion to the grounding terminal portion formed at the end of the resilient arm portion.

Especially, in the embodiment of the electrical coaxial connector according to the first or second aspect of the present invention, a plurality of resilient arm portions are provided on the ring-shaped end of the grounding contacting conductor or a couple of resilient arm portions are provided on the cylindrical side wall portion of the grounding contacting conductor with a predetermined space between and therefore the stress arising from the resilient transformation of the grounding contacting conductor formed into the cylindrical shape can be absorbed much more effectively into the resilient arm portions to be more effectively attenuated.

As explained above, with the electrical coaxial connector according to the first or second aspect of the present invention, the body of which is put on the circuit board with the signal-joining terminal portion of the contacting conductor connected to the signal terminal on the circuit board and the grounding terminal portion of the grounding contacting conductor soldered to the ground-potential terminal on the circuit board so that the electrical coaxial connector in its entirety is mounted on the circuit board, when the electrical coaxial connector is coupled with the other electrical coaxial connector and thereby the grounding contacting conductor formed into the cylindrical shape comes into contact with and then is in contact with the other grounding contacting conductor provided in the other electrical coaxial connector, the stress arising from the resilient transformation of the grounding contacting conductor formed into the cylindrical shape, which is caused by engagement with the other grounding contacting conductor provided in the other electrical coaxial connector, is absorbed into the resilient arm portion which extends toward the circuit board from one of the ring-shaped ends of the grounding contacting conductor, which is more distant from the circuit board than the other, or extends from the cylindrical side wall portion of the grounding contacting conductor in parallel with the circuit board to be attenuated. Therefore, the stress arising from the resilient transformation of the grounding contacting conductor and transmitted through the resilient arm portion to the grounding terminal portion formed at the end of the resilient arm portion can be effectively reduced.

As a result, with the electrical coaxial connector according to the first or second aspect of the present invention, such a fear that cracks in solder, remove of the grounding terminal portion of the grounding contacting conductor from the ground-potential terminal on the circuit board, separation of the ground-potential terminal from the circuit board and so on are brought about on a soldered portion on the circuit board at which the grounding terminal portion of the grounding contacting conductor is soldered to the ground-potential terminal provided on the circuit board by the stress exerted to the soldered portion and thereby the soldered condition of the grounding terminal portion provided on the grounding contacting conductor with the ground-potential terminal provided on the circuit board can not be properly maintained is surely minimized.

The above, and other objects, features and advantages of the present invention will become apparent from the following detailed description taken in conjunction with the accompanying drawings.

DESCRIPTION OF THE PREFERRED EMBODIMENTS

An embodiment of electrical coaxial connector according to the first aspect of the present invention will be explained making reference to FIGS. 1 to 8 and an embodiment of electrical coaxial connector according to the second aspect of the present invention will be explained making reference to FIGS. 9 to 14.

Figure 1:
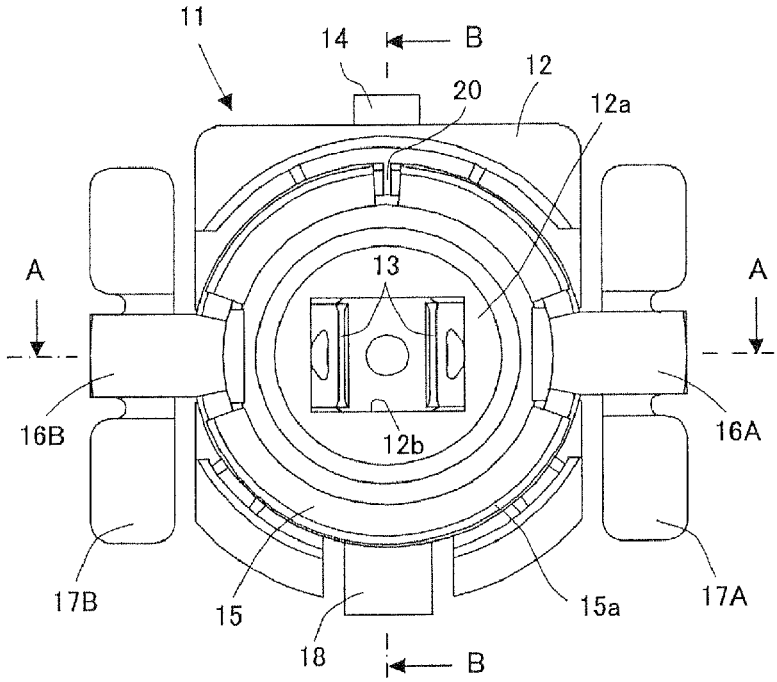
FIG. 1 is a schematic plane view showing an embodiment of electrical coaxial connector according to the first aspect of the present invention.
Figure 2:
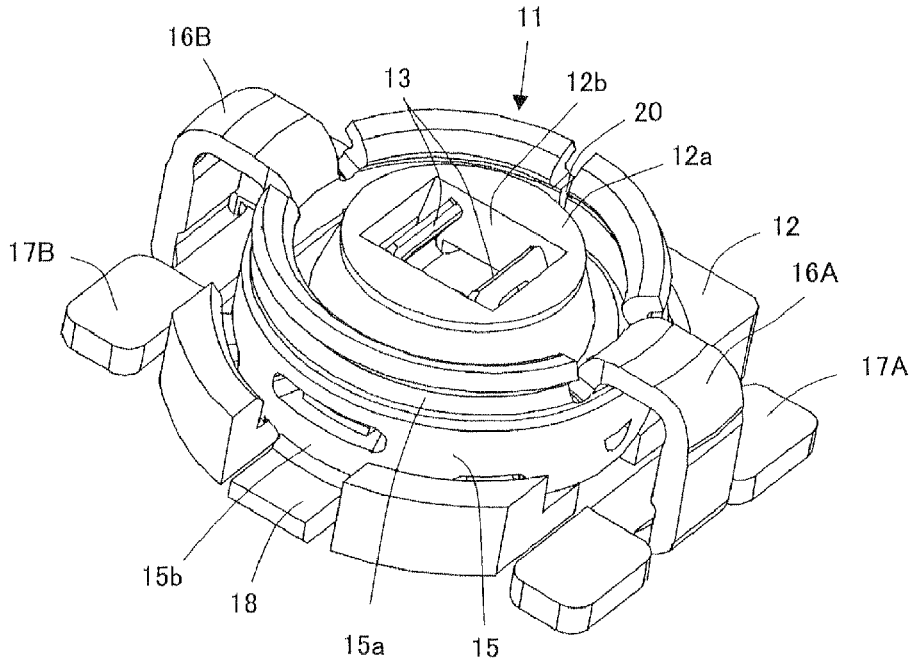
FIG. 2 is a schematic perspective view showing the embodiment of electrical coaxial connector according to the first aspect of the present invention.
Figure 3:
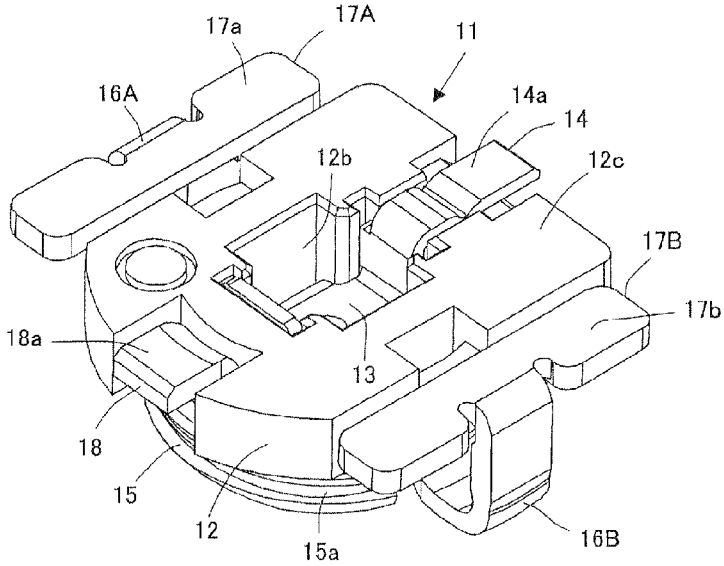
FIG. 3 is a schematic perspective view from the bottom side showing the embodiment of electrical coaxial connector according to the first aspect of the present invention.

FIGS. 1, 2 and 3 show the embodiment of electrical coaxial connector according to the first aspect of the present invention. Referring to FIGS. 1 to 3, an electrical coaxial connector 11, which constitutes the embodiment of electrical coaxial connector according to the first aspect of the present invention, is provided to be mounted on a circuit board and coupled with another electrical coaxial connector for practical use. The electrical coaxial connector 11 comprises a body 12 made of insulator such as plastics or the like to be put on the circuit board on which the electrical coaxial connector 11 is mounted. The body 12 is provided with a projection 12*a* formed into a columnar shape at its central portion. A rectangular perforation 12*b* is formed at a central portion of the projection 12*a*.

The electrical coaxial connector 11 comprises also a signal-joining contacting conductor 13 made of resilient conductive material such as a metal plate and put in the rectangular perforation 12*b* formed on the projection 12*a* of the body 12 to be held by the body 12. A pair of contact-connecting portions are provided respectively at ends of the signal-joining contacting conductor 13 opposite to each other for coming into contact with another signal-joining contacting conductor provided on the other electrical coaxial connector with which the electrical coaxial connector 11 is coupled. A signal-joining terminal portion 14 is provided on the signal-joining contacting conductor 13 for extending from the signal-joining contacting conductor 13 to the outside of the body 12 to be connected to a signal terminal provided on the circuit board on which the body 12 is put.

The electrical coaxial connector 11 further comprises a grounding contacting conductor 15 made of resilient conductive material such as a metal plate to be formed into a cylindrical shape and held by the body 12 for surrounding, on the circuit board on which the body 12 is put, the signal-joining contacting conductor 13 which is put in the rectangular perforation 12*b* formed on the projection 12*a* of the body 12. The grounding contacting conductor 15 has a pair of ring-shaped ends 15*a* and 15*b* opposite to each other in a direction perpendicular to the circuit board on which the body 12 is put. A pair of arm portions 16A and 16B are provided on a ring-shaped end 15*a* of the grounding contacting conductor 15, which is more distant from the circuit board on which the body 12 is put than another ring-shaped end 15*b* of the grounding contacting conductor 15. Each of the arm portions 16A and 16B is curved to extend from the ring-shaped end 15*a* of the grounding contacting conductor 15 toward the circuit board on which the body 12 is put. A grounding terminal portion 17A formed into a plate shape is provided at an end of the arm portion 16A to be soldered to a ground-potential terminal provided on the circuit board on which the body 12 is put and a grounding terminal portion 17B formed into a plate shape is provided at an end of the arm portion 16B to be soldered to a ground-potential terminal provided on the circuit board on which the body 12 is put. The arm portions 16A and 16B are opposite to each other and the signal-joining contacting conductor 13 put in the rectangular perforation 12*b* formed on the projection 12*a* of the body 12 is put between the arm portions 16A and 16B.

It is not always necessary that the arm portions 16A and 16B are positioned to be opposite to each other with the signal-joining contacting conductor 13 between and it is possible to provide the arm portions 16A and 16B respectively at another two positions on the ring-shaped end 15*a* of the grounding contacting conductor 15.

The arm portions 16A and 16B and the grounding terminal portions 17A and 17B are, for example, incorporated with the grounding contacting conductor 15 made of resilient conductive material and therefore each of the arm portions 16A and 16B is also resilient. As described above, since the grounding terminal portion 17A is provided at the end of the arm portion 16A which is curved to extend from the ring-shaped end 15*a* of the grounding contacting conductor 15 toward the circuit board on which the body 12 is put and the grounding terminal portion 17B is provided at the end of the arm portion 16B which is curved to extend from the ring-shaped end 15*a* of the grounding contacting conductor 15 toward the circuit board on which the body 12 is put, the grounding terminal portions 17A and 17B provided to be soldered to the ground-potential terminals provided on the circuit board on which the body 12 is put are connected through the arm portions 16A and 16B with the grounding contacting conductor 15 to be remote by the length of each of the arm portions 16A and 16B from the grounding contacting conductor 15.

A grounding terminal portion 18 is also provided on the ring-shaped end 15*b* of the grounding contacting conductor 15, which is more close to the circuit board on which the body 12 is put than the ring-shaped end 15*a*, for extending from the ring-shaped end 15*b* of the grounding contacting conductor 15 to the outside of the body 12 to be connected to a ground-potential terminal provided on the circuit board on which the body 12 is put.

A slit 20 is further provided on the grounding contacting conductor 15 for extending from the ring-shaped end 15*a* to the ring-shaped end 15*b* at a position between the arm portions 16A and 16B so as to provide a cylindrical side wall portion of the grounding contacting conductor 15 with a couple of divided opposite end portions.

As shown in FIG. 3, a bottom 12*c* of the body 12, a bottom 14*a* of the signal-joining terminal portion 14 provided on the signal-joining contacting conductor 13 and respective bottoms 17*a*, 17*b* and 18*a* of the grounding terminal portions 17A, 17B and 18 are substantially put on a common plane to come into contact with the circuit board on which the body 12 is put.

Figure 4:
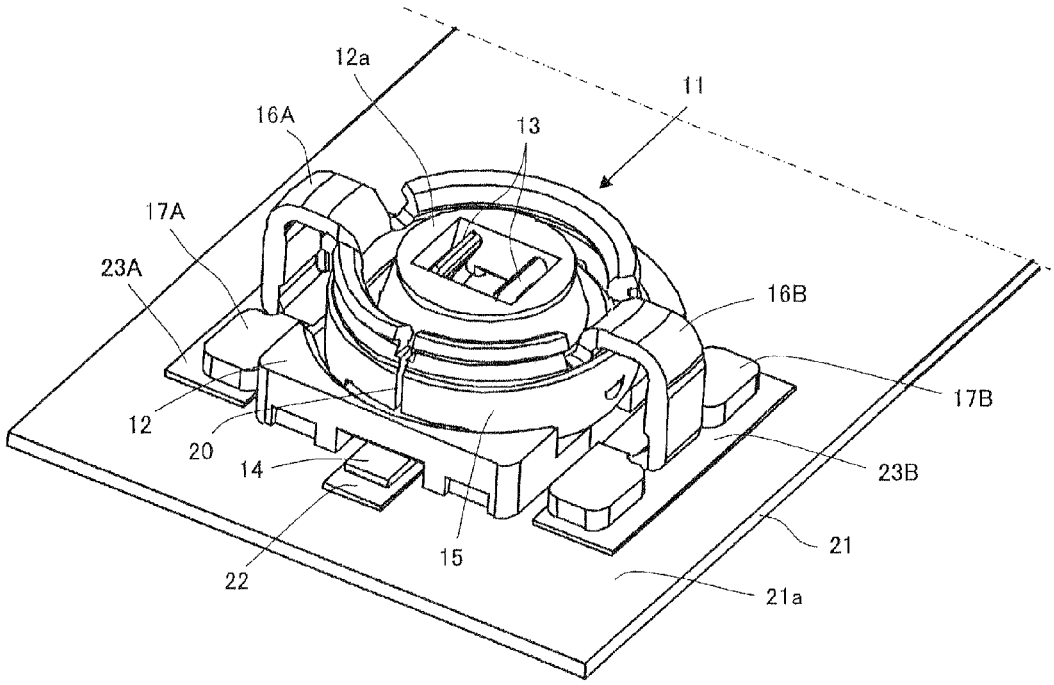
FIG. 4 is a schematic perspective view showing the embodiment of electrical coaxial connector according to the first aspect of the present invention mounted on a circuit board.

FIG. 4 shows the electrical coaxial connector 11 mounted on a circuit board 21 having a surface 21*a* on which the body 12 of the electrical coaxial connector 11 is put. A signal terminal 22 and ground-potential terminals 23A and 23B are provided on the circuit board 21 shown in FIG. 4. The electrical coaxial connector 11 is mounted on the circuit board 21 with the body 12 put on the surface 21*a* of circuit board 21, the signal-joining terminal portion 14 provided on the signal-joining contacting conductor 13 and connected, for example, by soldering to the signal terminal 22 provided on the circuit board 21, the grounding terminal portions 17A and 17B provided on the grounding contacting conductor 15 and soldered to the ground-potential terminals 23A and 23B, respectively, and the grounding terminal portion 18 (not shown in FIG. 4) provided on the grounding contacting conductor 15 and soldered to a ground-potential terminal provided on the circuit board 21. Although the soldering of the signal-joining terminal portion 14 to the signal terminal 22, the soldering of the grounding terminal portions 17A and 17B to the ground-potential terminals 23A and 23B and the soldering of the grounding terminal portion 18 to the ground-potential terminal are conducted by means of the surface mounting method in the embodiment shown in FIG. 4, it is also possible to constitute the electrical coaxial connector 11 in such a manner that the soldering of the signal-joining terminal portion 14 to the signal terminal 22, the soldering of the grounding terminal portions 17A and 17B to the ground-potential terminals 23A and 23B and the soldering of the grounding terminal portion 18 to the ground-potential terminal are conducted by means of the solder dipping method.

Figure 5:
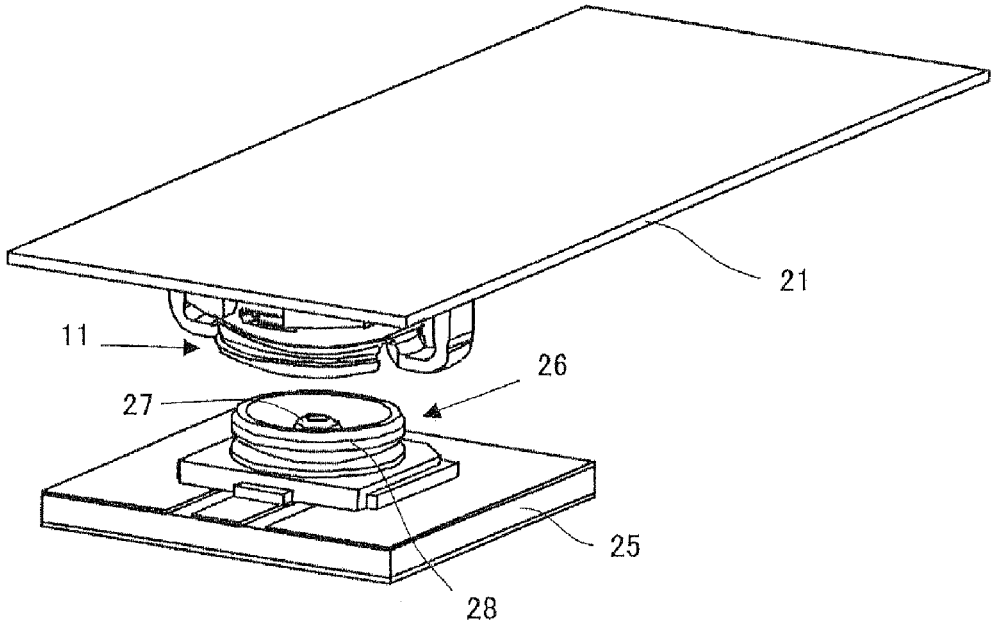
FIG. 5 is a schematic perspective view showing the embodiment of electrical coaxial connector according to the first aspect of the present invention mounted on the circuit board and positioned to be opposite to another electrical coaxial connector.
Figure 6:
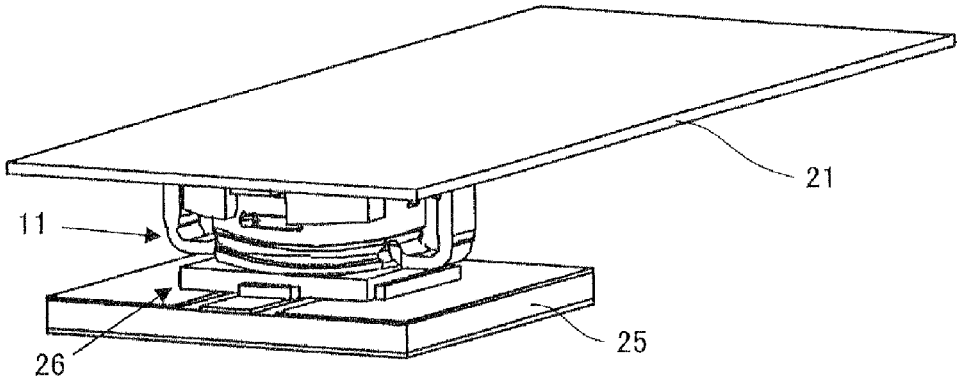
FIG. 6 is a schematic perspective view showing the embodiment of electrical coaxial connector according to the first aspect of the present invention mounted on the circuit board and coupled with the other electrical coaxial connector.

FIG. 5 shows the electrical coaxial connector 11 mounted on the circuit board 21 as shown in FIG. 4 and positioned to be opposite to another electrical coaxial connector 26 mounted on another circuit board 25 for coupling with the same. The electrical coaxial connector 26 is provided with a signal-joining contacting conductor 27 and a grounding contacting conductor 28. The electrical coaxial connector 11 shown in FIG. 5 is then coupled with the electrical coaxial connector 26 as shown in FIG. 6 so as to be connected electrically to the same.

Figure 7:
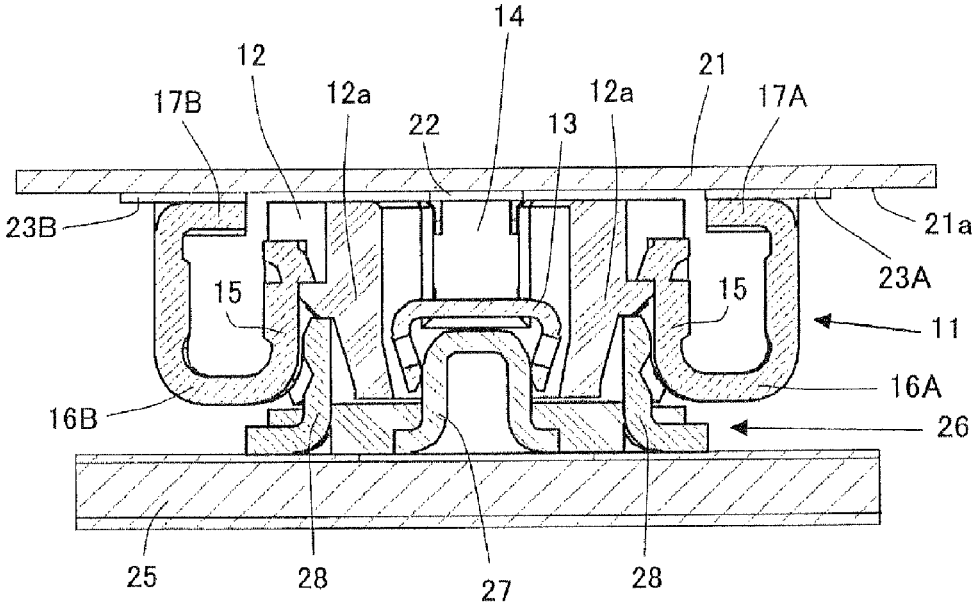
FIG. 7 is a schematic cross sectional view including a cross section taken along line A-A in FIG. 1 and showing the embodiment of electrical coaxial connector according to the first aspect of the present invention mounted on the circuit board and coupled with the other electrical coaxial connector.
Figure 8:
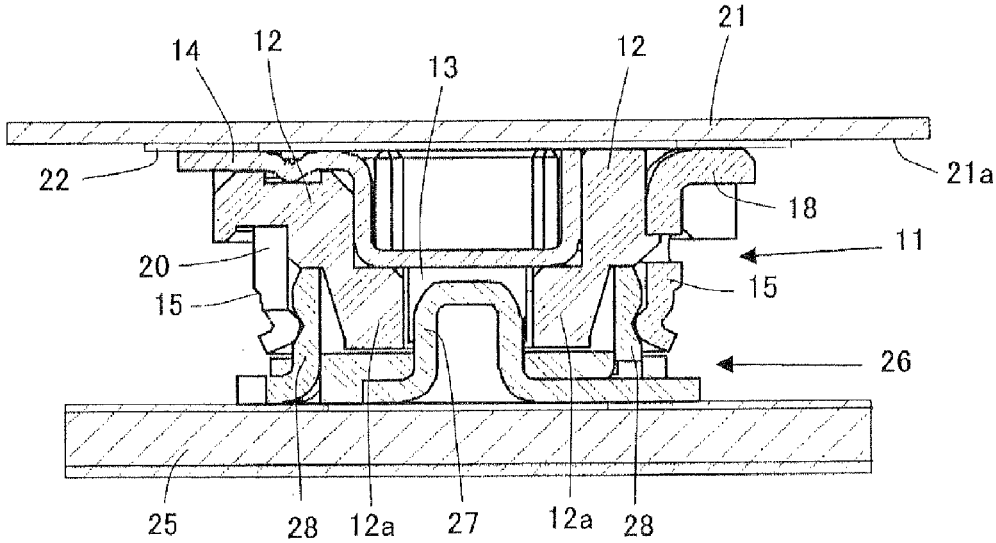
FIG. 8 is a schematic cross sectional view including a cross section taken along line B-B in FIG. 1 and showing the embodiment of electrical coaxial connector according to the first aspect of the present invention mounted on the circuit board and coupled with the other electrical coaxial connector.

FIG. 7 is a schematic cross sectional view including a cross section taken along a line A-A and showing the electrical coaxial connector 11 which is mounted on the circuit board 21 and coupled with the electrical coaxial connector 26 mounted on the circuit board 25. FIG. 8 is a schematic cross sectional view including a cross section taken along a line B-B and showing also the electrical coaxial connector 11 which is mounted on the circuit board 21 and coupled with the electrical coaxial connector 26 mounted on the circuit board 25.

When the electrical coaxial connector 11 is coupled with the electrical coaxial connector 26 as shown in FIGS. 7 and 8, the signal-joining contacting conductor 13 of the electrical coaxial connector 11 comes into contact with the signal-joining contacting conductor 27 of the electrical coaxial connector 26 and the grounding contacting conductor 15 of the electrical coaxial connector 11, which is formed into the cylindrical shape, comes into contact with the grounding contacting conductor 28 of the electrical coaxial connector 26.

The grounding contacting conductor 15 of the electrical coaxial connector 11 formed into the cylindrical shape is resiliently transformed by engagement with the grounding contacting conductor 28 of the electrical coaxial connector 26 and operative to exert resilient force arising from its transformation to the grounding contacting conductor 28 of the electrical coaxial connector 26 and to lock the same when the grounding contacting conductor 15 of the electrical coaxial connector 11 comes into contact with and then is in contact with the grounding contacting conductor 28 of the electrical coaxial connector 26.

The slit 20, which is provided on the grounding contacting conductor 15 for extending from the ring-shaped end 15*a* to the ring-shaped end 15*b* so as to provide the cylindrical side wall portion of the grounding contacting conductor 15 with the divided opposite end portions, is operative to aid the grounding contacting conductor 15 to be resiliently transformed. The slit 20 is, however, not always necessary for the resilient transformation of the grounding contacting conductor 15.

On this occasion, stress arising from the resilient transformation of the grounding contacting conductor 15 of the electrical coaxial connector 11 is wasted to transform resiliently each of the arm portions 16A and 16B which extends toward the circuit board 21 from the ring-shaped end 15*a* of the grounding contacting conductor 15 and absorbed into each of the arm portions 16A and 16B to be attenuated. As a result, the stress arising from the resilient transformation of the grounding contacting conductor 15 of the electrical coaxial connector 11 is effectively reduced to be less transmitted through the arm portions 16A and 16B to the grounding terminal portions 17A and 17B which are formed at the ends of the arm portions 16A and 16B, respectively.

Therefore, the stress arising from the resilient transformation of the grounding contacting conductor 15 and exerted to a soldered portion on the circuit board 21 at which the grounding terminal portion 17A of the grounding contacting conductor 15 is soldered to the ground-potential terminal 23A provided on the circuit board 21 and a soldered portion on the circuit board 21 at which the grounding terminal portion 17B of the grounding contacting conductor 15 is soldered to the ground-potential terminal 23B provided on the circuit board 21 is effectively reduced. As a result, such a fear that cracks in solder, remove of the grounding terminal portion 17A of the grounding contacting conductor 15 from the ground-potential terminal 23A on the circuit board 21, separation of the ground-potential terminal 23A from the circuit board 21 and so on are brought about on the soldered portion on the circuit board 21, at which the grounding terminal portion 17A of the grounding contacting conductor 15 is soldered to the ground-potential terminal 23A provided on the circuit board 21, by the stress exerted thereto or cracks in solder, remove of the grounding terminal portion 17B of the grounding contacting conductor 15 from the ground-potential terminal 23B on the circuit board 21, separation of the ground-potential terminal 23B from the circuit board 21 and so on are brought about on the soldered portion on the circuit board 21, at which the grounding terminal portion 17B of the grounding contacting conductor 15 is soldered to the ground-potential terminal 23B provided on the circuit board 21, by the stress exerted thereto, and thereby the soldered condition of the grounding terminal portions 17A and 17B of the grounding contacting conductor 15 with the ground-potential terminals 23A and 23B provided on the circuit board 21 can not be properly maintained, is surely minimized.

Although the arm portions 16A and 16B each extending from the ring-shaped end 15*a* toward the circuit board 21 on which the body 12 is put are provided on the ring-shaped 15*a* of the grounding contacting conductor 15 in the electrical coaxial connector 11 shown in FIGS. 1 to 3, it should be understood that it is possible for the electrical coaxial connector according to the first aspect of the present invention to have one or more than three arm portions each corresponding to the arm portion 16A or 16B and having a grounding terminal portion corresponding to the grounding terminal portion 17A or 17B. With such an electrical coaxial connector according to the first aspect of the present invention having one or more than three arm portions, advantages similar to those obtained with the electrical coaxial connector 11 shown in FIGS. 1 to 3 can be obtained and, in case of the electrical coaxial connector according to the first aspect of the present invention having more than three arm portions, stress arising from resilient transformation of a grounding contacting conductor corresponding to the grounding contacting conductor 15 of the electrical coaxial connector 11 can be absorbed much more effectively into the arm portions to be more effectively attenuated compared with the electrical coaxial connector according to the first aspect of the present invention having one arm portion.

Figure 9:
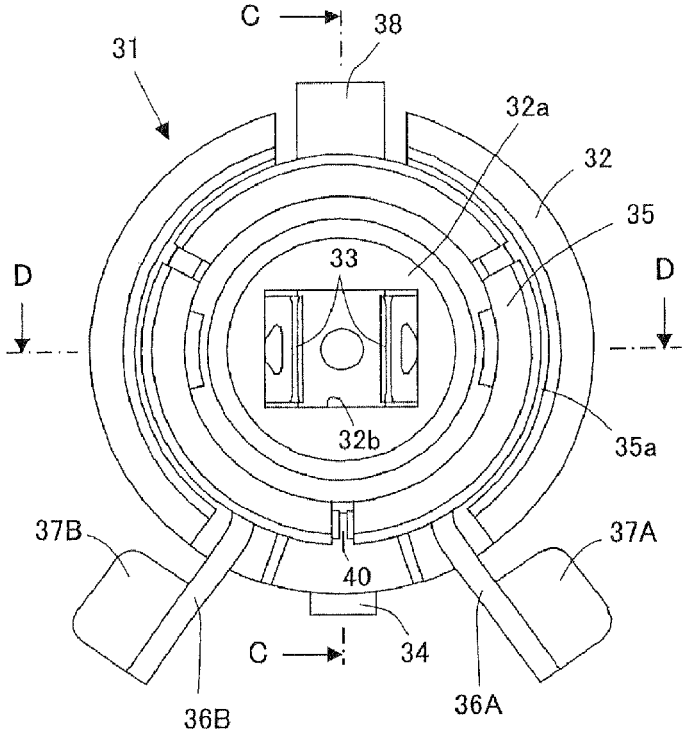
FIG. 9 is a schematic plane view showing an embodiment of electrical coaxial connector according to the second aspect of the present invention.
Figure 10:
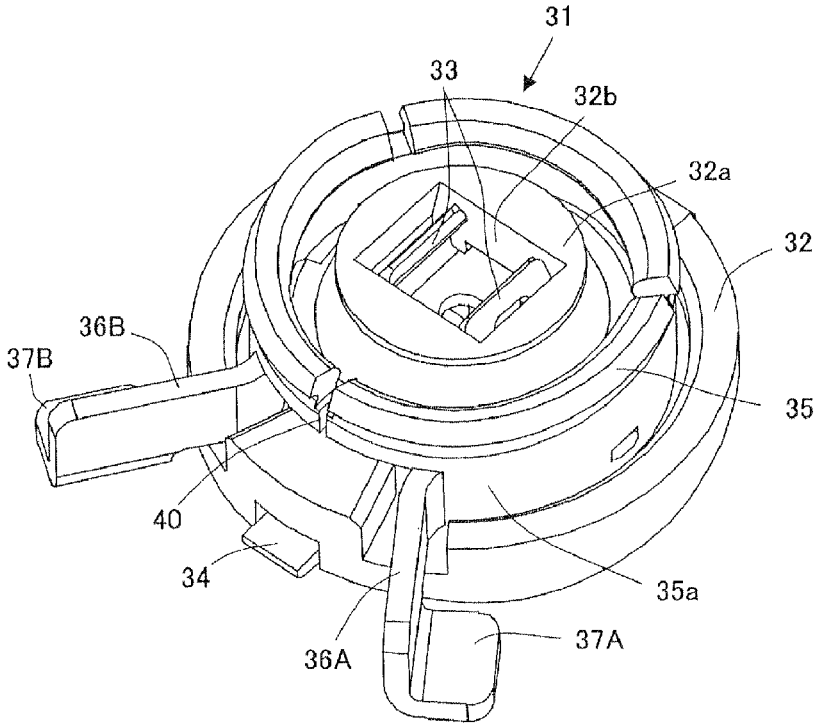
FIG. 10 is a schematic perspective view showing the embodiment of electrical coaxial connector according to the second aspect of the present invention.
Figure 11:
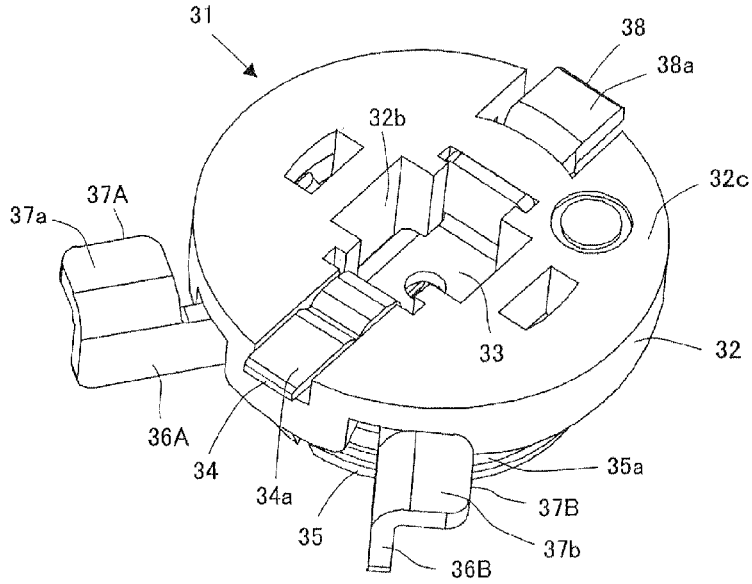
FIG. 11 is a schematic perspective view from the bottom side showing the embodiment of electrical coaxial connector according to the second aspect of the present invention.

FIGS. 9, 10 and 11 show the embodiment of electrical coaxial connector according to the second aspect of the present invention. Referring to FIGS. 9 to 11, an electrical coaxial connector 31, which constitutes the embodiment of electrical coaxial connector according to the second aspect of the present invention, is provided to be mounted on a circuit board and coupled with another electrical coaxial connector for practical use in the same manner as the electrical coaxial connector 11 shown in FIGS. 1 to 3. The electrical coaxial connector 31 comprises a body 32 made of insulator such as plastics or the like to be put on a surface of the circuit board on which the electrical coaxial connector 31 is mounted. The body 32 is provided with a projection 32*a* formed into a columnar shape at its central portion. A rectangular perforation 32*b* is formed at a central portion of the projection 32*a*.

The electrical coaxial connector 31 comprises also a signal-joining contacting conductor 33 made of resilient conductive material such as a metal plate and put in the rectangular perforation 32*b* formed on the projection 32*a* of the body 32 to be held by the body 32. A pair of contact-connecting portions are provided respectively at ends of the signal-joining contacting conductor 33 opposite to each other for coming into contact with another signal-joining contacting conductor provided on the other electrical coaxial connector with which the electrical coaxial connector 31 is coupled. A signal-joining terminal portion 34 is provided on the signal-joining contacting conductor 33 for extending from the signal-joining contacting conductor 33 to the outside of the body 32 to be connected to a signal terminal provided on the circuit board on which the body 32 is put.

The electrical coaxial connector 31 further comprises a grounding contacting conductor 35 made of resilient conductive material such as a metal plate to be formed into a cylindrical shape and held by the body 32 for surrounding on the circuit board on which the body 32 is put the signal-joining contacting conductor 33 which is put in the rectangular perforation 32*b* formed on the projection 32*a* of the body 32. A pair of arm portions 36A and 36B are provided on the grounding contacting conductor 35. Each of the arm portions 36A and 36B extends from a cylindrical side wall portion 35*a* of the grounding contacting conductor 35 in parallel with the surface of the circuit board on which the body 32 is put.

A grounding terminal portion 37A formed into a plate shape is provided at an end of the arm portion 36A to be soldered to a ground-potential terminal provided on the circuit board, on the surface of which the body 32 is put, and a grounding terminal portion 37B formed into a plate shape is provided at an end of the arm portion 36B to be soldered to a ground-potential terminal provided on the circuit board, on the surface of which the body 32 is put. The arm portions 36A and 36B are so positioned that a predetermined space is formed between the arm portions 36A and 36B.

The arm portions 36A and 36B and the grounding terminal portions 37A and 37B are, for example, incorporated with the grounding contacting conductor 35 made of resilient conductive material and therefore each of the arm portions 36A and 36B is also resilient. As described above, since the grounding terminal portion 37A is provided at the end of the arm portion 36A which extends from the cylindrical side wall portion 35*a* of the grounding contacting conductor 35 in parallel with the surface of the circuit board on which the body 32 is put and the grounding terminal portion 37B is provided at the end of the arm portion 36B which extends from the cylindrical side wall portion 35*a* of the grounding contacting conductor 35 in parallel with the surface of the circuit board on which the body 32 is put, the grounding terminal portions 37A and 37B provided to be soldered to the ground-potential terminals provided on the circuit board, on the surface of which the body 32 is put, are connected through the arm portions 36A and 36B with the grounding contacting conductor 35 to be remote by the length of each of the arm portions 36A and 36B from the grounding contacting conductor 35.

A grounding terminal portion 38 is also provided on a ring-shaped end of the grounding contacting conductor 35, which is more close to the circuit board, on the surface of which the body 32 is put, than another ring-shaped end of the grounding contacting conductor 35, for extending from the grounding contacting conductor 35 to the outside of the body 32 to be connected to a ground-potential terminal provided on the circuit board, on the surface of which the body 32 is put.

A slit 40 is further formed on the grounding contacting conductor 35 for providing the cylindrical side wall 35*a* of the grounding contacting conductor 35 with a couple of divided opposite end portions at a position between the arm portions 36A and 36B.

As shown in FIG. 11, a bottom 32*c* of the body 32, a bottom 34*a* of the signal-joining terminal portion 34 provided on the signal-joining contacting conductor 33 and respective bottoms 37*a*, 37*b* and 38*a* of the grounding terminal portions 37A, 37B and 38 are substantially put on a common plane to come into contact with the circuit board, on the surface of which the body 32 is put.

Figure 12:
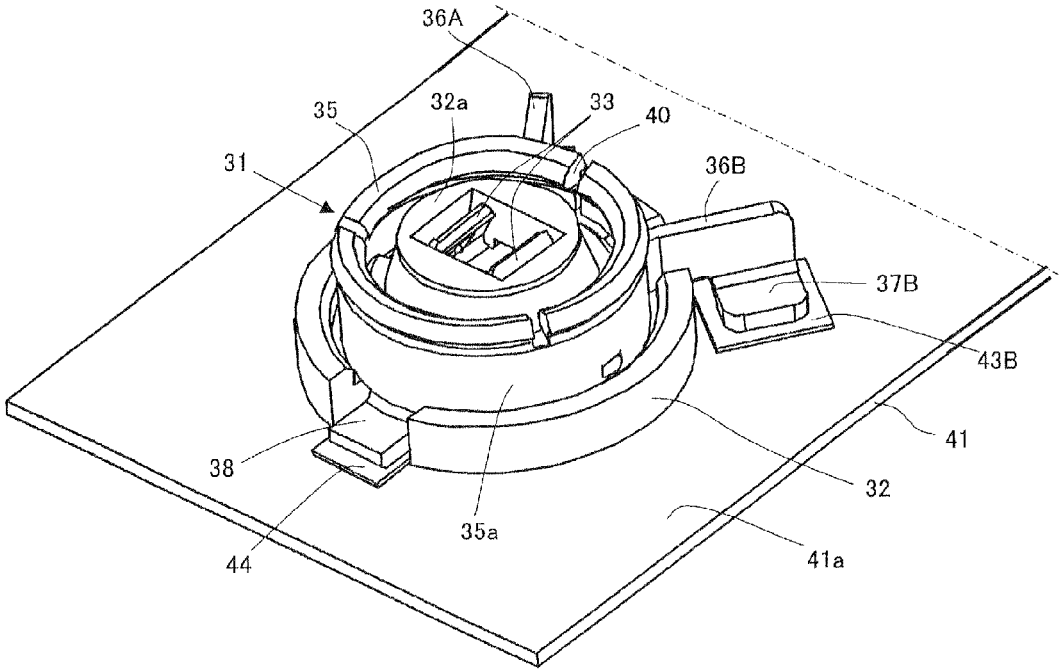
FIG. 12 is a schematic perspective view showing the embodiment of electrical coaxial connector according to the second aspect of the present invention mounted on a circuit board.

FIG. 12 shows the electrical coaxial connector 31 mounted on a circuit board 41 having a surface 41*a* on which the body 32 of the electrical coaxial connector 31 is put. A signal terminal 42 and ground-potential terminals 43A, 43B and 44 are provided on the circuit board 41 shown in FIG. 4. The signal terminal 42 and the ground-potential terminal 43A are in hiding behind the grounding contacting conductor 35 in FIG. 12.

The electrical coaxial connector 31 is mounted on the circuit board 41 with the body 32 put on the surface 41*a* of the circuit board 41, the signal-joining terminal portion 34 provided on the signal-joining contacting conductor 33 and connected, for example, by soldering to the signal terminal 42 provided on the circuit board 41, the grounding terminal portions 37A and 37B provided on the grounding contacting conductor 35 and soldered to the ground-potential terminals 43A and 43B, respectively, and the grounding terminal portion 38 provided on the grounding contacting conductor 35 and soldered to the ground-potential terminal 44 provided on the circuit board 41. Although the soldering of the signal-joining terminal portion 34 to the signal terminal 42, the soldering of the grounding terminal portions 37A and 37B to the ground-potential terminals 43A and 43B and the soldering of the grounding terminal portion 38 to the ground-potential terminal 44 are conducted by means of the surface mounting method in the embodiment shown in FIG. 12, it is also possible to constitute the electrical coaxial connector 31 in such a manner that the soldering of the signal-joining terminal portion 34 to the signal terminal 42, the soldering of the grounding terminal portions 37A and 37B to the ground-potential terminals 43A and 43B and the soldering of the grounding terminal portion 38 to the ground-potential terminal 44 are conducted by means of the solder dipping method.

The electrical coaxial connector 31 thus mounted on the circuit board 41 is then coupled with the other electrical coaxial connector mounted on another circuit board.

Figure 13:
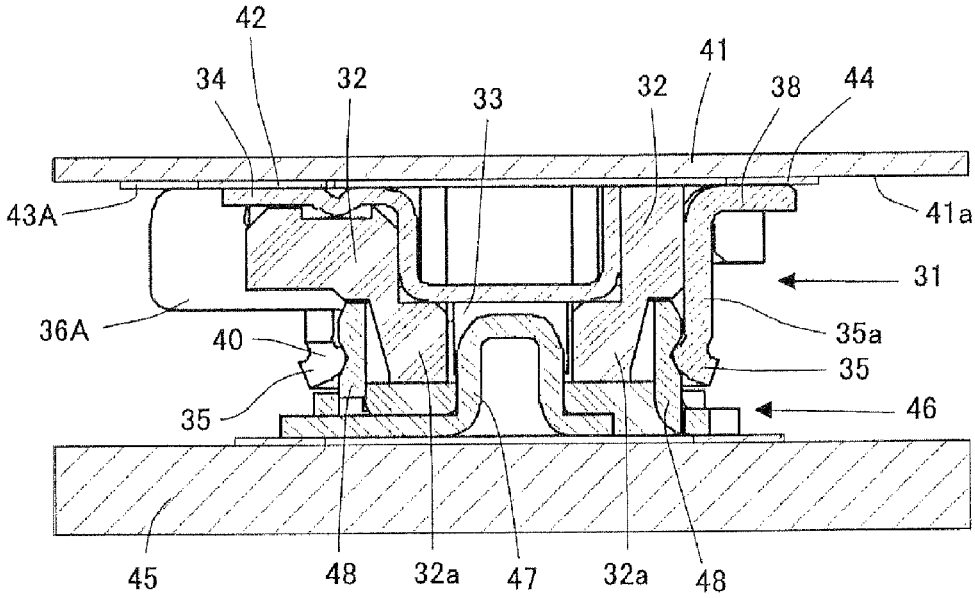
FIG. 13 is a schematic cross sectional view including a cross section taken along line C-C in FIG. 9 and showing the embodiment of electrical coaxial connector according to the second aspect of the present invention mounted on the circuit board and coupled with the other electrical coaxial connector.
Figure 14:
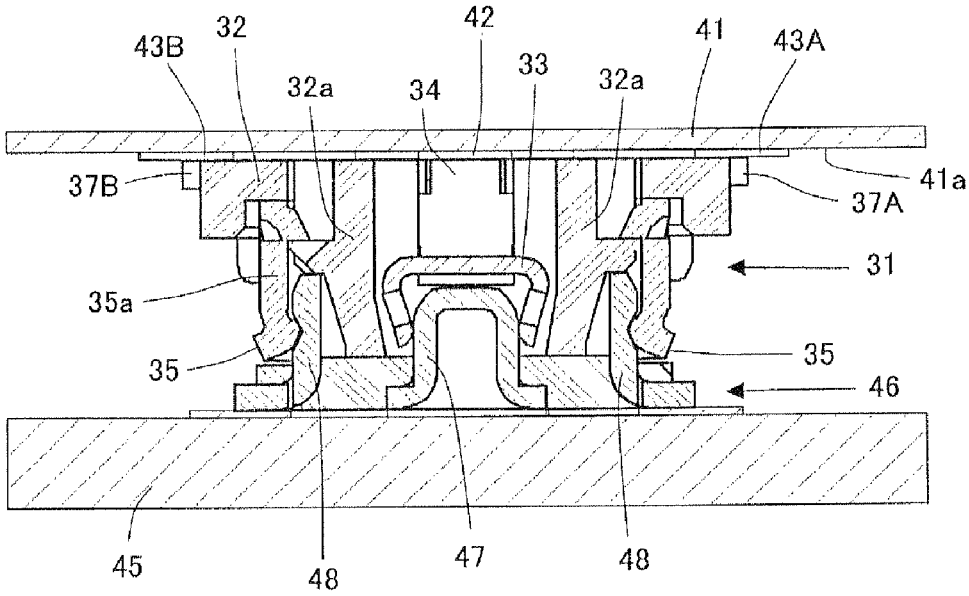
FIG. 14 is a schematic cross sectional view including a cross section taken along line D-D in FIG. 9 and showing the embodiment of electrical coaxial connector according to the second aspect of the present invention mounted on the circuit board and coupled with the other electrical coaxial connector.

FIG. 13 is a schematic cross sectional view including a cross section taken along a line C-C and showing the electrical coaxial connector 31 which is mounted on the circuit board 41 and coupled with another electrical coaxial connector 46 mounted on a circuit board 45. FIG. 14 is a schematic cross sectional view including a cross section taken along a line D-D and showing also the electrical coaxial connector 31 which is mounted on the circuit board 41 and coupled with the electrical coaxial connector 46 mounted on the circuit board 45.

When the electrical coaxial connector 31 is coupled with the electrical coaxial connector 46 as shown in FIGS. 13 and 14, the signal-joining contacting conductor 33 of the electrical coaxial connector 31 comes into contact with a signal-joining contacting conductor 47 of the electrical coaxial connector 46 and the grounding contacting conductor 35 of the electrical coaxial connector 31, which is formed into the cylindrical shape, comes into contact with a grounding contacting conductor 48 of the electrical coaxial connector 46.

The grounding contacting conductor 35 of the electrical coaxial connector 31 formed into the cylindrical shape is resiliently transformed by engagement with the grounding contacting conductor 48 of the electrical coaxial connector 46 and operative to exert resilient force arising from its transformation to the grounding contacting conductor 48 of the electrical coaxial connector 46 and to lock the same when the grounding contacting conductor 35 of the electrical coaxial connector 31 comes into contact with and then is in contact with the grounding contacting conductor 48 of the electrical coaxial connector 46.

The slit 40, which is formed on the grounding contacting conductor 35 for providing the cylindrical side wall portion 35*a* of the grounding contacting conductor 35 with the divided opposite end portions, is operative to aid the grounding contacting conductor 35 to be resiliently transformed. The slit 40 is, however, not always necessary for the resilient transformation of the grounding contacting conductor 35.

On this occasion, stress arising from the resilient transformation of the grounding contacting conductor 35 of the electrical coaxial connector 31 is wasted to transform resiliently each of the arm portions 36A and 36B which extends from the cylindrical side wall portion 35*a* of the grounding contacting conductor 35 in parallel with the surface 41*a* of the circuit board 41 on which the body 32 is put and absorbed into each of the arm portions 36A and 36B to be attenuated. As a result, the stress arising from the resilient transformation of the grounding contacting conductor 35 of the electrical coaxial connector 31 is effectively reduced to be less transmitted through the arm portions 36A and 36B to the grounding terminal portions 37A and 37B which are formed at the ends of the arm portions 36A and 36B, respectively.

Therefore, the stress arising from the resilient transformation of the grounding contacting conductor 35 of the electrical coaxial connector 31 and exerted on a soldered portion on the circuit board 41 at which the grounding terminal portion 37A of the grounding contacting conductor 35 is soldered to the ground-potential terminal 43A provided on the circuit board 41 and a soldered portion on the circuit board 41 at which the grounding terminal portion 37B of the grounding contacting conductor 35 is soldered to the ground-potential terminal 43B provided on the circuit board 41 is effectively reduced. As a result, such a fear that cracks in solder, remove of the grounding terminal portion 37A of the grounding contacting conductor 35 from the ground-potential terminal 43A on the circuit board 41, separation of the ground-potential terminal 43A from the circuit board 41 and so on are brought about on the soldered portion on the circuit board 41, at which the grounding terminal portion 37A of the grounding contacting conductor 35 is soldered to the ground-potential terminal 43A provided on the circuit board 41, by the stress exerted thereto or cracks in solder, remove of the grounding terminal portion 37B of the grounding contacting conductor 35 from the ground-potential terminal 43B on the circuit board 41, separation of the ground-potential terminal 43B from the circuit board 41 and so on are brought about on the soldered portion on the circuit board 41, at which the grounding terminal portion 37B of the grounding contacting conductor 35 is soldered to the ground-potential terminal 43B provided on the circuit board 41, by the stress exerted thereto and thereby the soldered condition of the grounding terminal portions 37A and 37B of the grounding contacting conductor 35 with the ground-potential terminals 43A and 43B provided on the circuit board 41 can not be properly maintained, is surely minimized.

Although the arm portions 36A and 36B each extending from the cylindrical side wall portion 35*a* in parallel with the surface 41*a* of the circuit board 41 on which the body 32 is put are provided on the grounding contacting conductor 35 in the electrical coaxial connector 31 shown in FIGS. 9 to 11, it should be understood that it is possible for the electrical coaxial connector according to the second aspect of the present invention to have one or more than three arm portions each corresponding to the arm portion 36A or 36B and having a grounding terminal portion corresponding to the grounding terminal portion 37A or 37B. With such an electrical coaxial connector according to the second aspect of the present invention having one or more than three arm portions, advantages similar to those obtained with the electrical coaxial connector 31 shown in FIGS. 9 to 11 can be obtained and, in case of the electrical coaxial connector according to the second aspect of the present invention having more than three arm portions, stress arising from resilient transformation of a grounding contacting conductor corresponding to the grounding contacting conductor 35 of the electrical coaxial connector 31 can be absorbed much more effectively into the arm portions to be more effectively attenuated compared with the electrical coaxial connector according to the second aspect of the present invention having one arm portion.

What is claimed is:

1. An electrical coaxial connector comprising;

a body made of insulator having a base with a cylindrical wall to be put on a circuit board, a signal-joining contacting conductor held by the body and provided with a signal-joining terminal portion to be connected to a signal terminal provided on the circuit board, and a grounding contacting conductor formed into a cylindrical shape and held also by the body for surrounding the signal-joining contacting conductor on the circuit board, wherein the grounding contacting conductor has an arm portion extending outwardly from a cylindrical side wall portion of the grounding contacting conductor and through the cylindrical base wall, the arm portion being positioned perpendicular to the base and having a grounding terminal portion extended perpendicular from a side end of the arm portion and in parallel with the circuit board, the grounding terminal portion is formed at an end of the arm portion to be soldered to a ground-potential terminal provided on the circuit board, and each of the grounding contacting conductor and the arm portion is resilient; and wherein a pair of arm portions are provided on the cylindrical side wall portion of the grounding contacting conductor with a predetermined space between.

2. An electrical coaxial connector according to claim 1, wherein a slit is formed on the grounding contacting conductor for providing the cylindrical side wall portion with a couple of divided opposite end portions at a position between the arm portions.

* * * * *